United States Patent [19]

Warren

[11] Patent Number: 4,967,668

[45] Date of Patent: Nov. 6, 1990

[54] PULLER SABOT FOR LONG ROD PROJECTILES

[75] Inventor: John B. Warren, Plymouth, Minn.

[73] Assignee: Honeywell Inc., Minneapolis, Minn.

[21] Appl. No.: 495,506

[22] Filed: Mar. 19, 1990

Related U.S. Application Data

[63] Continuation-in-part of Ser. No. 421,910, Oct. 16, 1989, abandoned.

[51] Int. Cl.[5] ..... F42B 5/02

[52] U.S. Cl. ..... 102/522; 102/439

[58] Field of Search ..... 102/374, 376, 380, 430, 102/433, 434, 439, 489, 520, 521, 522, 523

[56] References Cited

U.S. PATENT DOCUMENTS

| | | | |
|---|---|---|---|
| 2,866,412 | 12/1958 | Meyer et al. | 102/430 |
| 3,834,314 | 9/1974 | Young | 102/521 |
| 3,853,057 | 12/1974 | Rickert et al. | 102/520 |
| 4,015,527 | 4/1977 | Evans | 102/433 |
| 4,215,632 | 8/1980 | Sie | 102/521 |
| 4,542,696 | 9/1985 | Bisping et al. | 102/523 |
| 4,604,954 | 8/1986 | Clarke et al. | 102/434 |
| 4,651,649 | 3/1987 | Nussbaum | 102/521 |
| 4,671,182 | 6/1987 | Zierler et al. | 102/521 |
| 4,732,086 | 3/1988 | Schiestl et al. | 102/513 |

FOREIGN PATENT DOCUMENTS

| | | | |
|---|---|---|---|
| 1016766 | 11/1952 | France | 102/520 |

*Primary Examiner*—Charles T. Jordan
*Assistant Examiner*—Michael J. Carone
*Attorney, Agent, or Firm*—John G. Shudy, Jr.; Roger W. Jensen

[57] ABSTRACT

This invention comprises a puller sabot characterized by a forward stabilizing disk, a rear stabilizing disk and a mid section. The obturator is located on the forward stabilizing disk. The rear stabilizing disk has a plurality of openings extending longitudinally through the rear stabilizing disk such that propellant may be located forward of the rear disk and ignited and vented. The sabot surrounds the peripheral mid section of a long rod fin stabilized projectile and guides the sub-projectile through a rifled barrel.

5 Claims, 2 Drawing Sheets

PULLER SABOT FOR LONG ROD PROJECTILES

This application is a continuation-in-part of application Ser. No. 07/421,910, filed Oct. 16, 1989, now abandoned.

BACKGROUND OF THE INVENTION

This invention relates to cased telescoped ammunition comprising, in part, a long rod fin stabilized projectile. In particular it relates to a sabot means for guiding the projectile down a rifled barrel.

In the past saddle sabots have been used to guide a long rod fin stabilized projectile down a rifled barrel. The saddle sabot is shaped, as the name implies, similar to a saddle with a front and rear stabilizing disk. The sabot engages and surrounds the midsection of the projectile, the front and rear stabilizing disks being positioned such that they support the front and rear portions of the projectile. This enables the sabot to prevent the projectile from oscillating when it is fired.

As long rod penetrators are typically launched from rifled barrels they pick up some spin as they travel down the barrel. For a long rod projectile a high rate of spin is detrimental. A saddle sabot has stabilizing rings and will not readily pick the rifling of the barrel, as the stabilizing rings ride the bore or barrel and not the rifling. If the projectile were to pick up rifling (and thus spin) there are two immediate concerns that are realized. The first is that the fin stabilized projectile will be damaged due to the high number of revolutions per minute imposed upon it. The second is that the sabot will become deformed while picking up the rifling. This will cause the projectile to leave the bore of the barrel at an increased angle relative to the axis of the bore and thereby become inaccurate.

Although a saddle sabot will support the long rod projectile while traveling down the barrel it has a disadvantage. A saddle sabot has the obturator, the pressure sealing surface, on the rear stabilizing ring. The amount of volume left for propellant is therefore restricted. This affects the performance of the device and forces the manufacturer to use a consolidated propellant to reach performance goals. A consolidated propellant is a propellant that is formed to the cartridge to increase the amount of energetic material present. A granular propellant is preferred, as it is more repeatable and involves fewer total steps in loading of the cartridge.

A puller sabot is an arrangement designed with an obturator located forward of the penetrator's center of gravity. A puller sabot is in essence a saddle sabot with out the rear stabilizing disk. This increases the volume available for propellant and increases the performance. Puller sabots of prior art however, lack proper guidance of the projectile while traveling down the barrel. As stated before this leads to oscillations and possible damage to the projectile prior to exiting the barrel. U.S. Pat. No. 4,444,114 issued to Bisping et al., teaches a method of supporting a long rod fin projectile yet still has the advantages of a puller sabot. This sabot uses a plurality of ribs to support the projectile as it travels down the barrel. These ribs could possibly engage the rifling of the barrel and start the projectile oscillating, destroying the projectile in-bore.

Prior designs show puller sabots and saddle sabots both of which serve a purpose. However, no prior art has been able to properly stabilize a long rod finned projectile as it travels down a rifled barrel, while still providing maximum volume for propellant in the cartridge.

SUMMARY OF THE INVENTION

This invention is a saddle sabot, that supports a long rod sub-projectile, adapted for a rifled barrel. In particular it is a saddle sabot with a front and rear stabilizing disks, and an obturator located on the front stabilizing disk. By locating the obturator on the front stabilizing disk the sabot is in essence a puller sabot, and has all of the advantages of the aforementioned puller sabot. It is possible to locate the obturator on the front stabilizing disk as the rear stabilizing disk has a plurality of openings extending longitudinally therethrough. The vents through the rear stabilizing disk provide a means for venting and igniting propellant stored forward of the rear stabilizing disk. This increases the amount of propellant that is added to the cartridge overall. The invention has all of the advantages of a puller sabot in that the area provided for propellant is greatly increased, however, the rear stabilizing disk prevents the longitudinal excursions characteristic of prior art puller sabots.

PREFERRED EMBODIMENT

Figure 1:
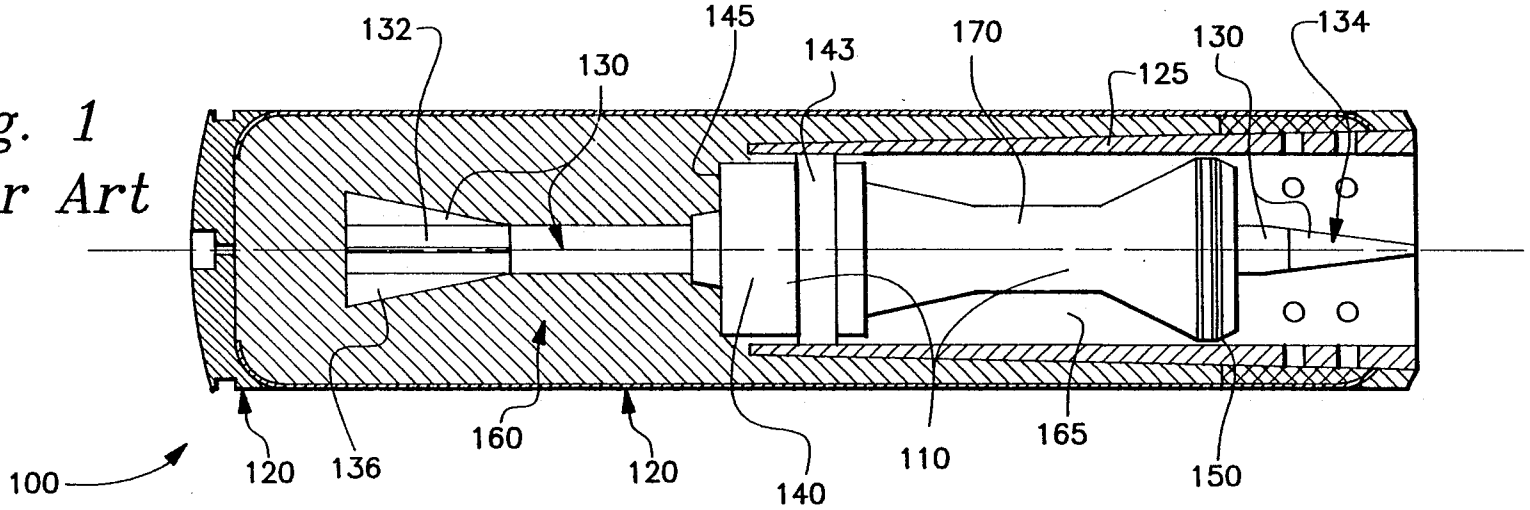
Fig. 1 Prior Art
FIG.1 illustrates a saddle sabot.

Referring to FIG. 1, reference 100 in general designates an ammunition with a saddle sabot 110 for a long rod fin stabilized projectile, known as the sub-projectile 130. The saddle sabot 110, is shown in a cartridge 120 with a forward guide tube 125. The sabot 110 is shaped, as the name implies similar to a saddle, with a forward guide disk or stabilizing disk 150 and a rear guide disk 140 with substantially similar diameters to the guide tube 125 and a midsection 170 smaller in diameter than the guide tube 125. The obturator 143 prevents propellant gases from escaping past the pressure receiving surface 145. The pressure receiving surface 145 propels the sabot 110 and a sub-projectile or penetrator 130 out of the cartridge 120 and down the bore or barrel of the gun.

The saddle sabot 110 engages the peripheral mid section of a long rod fin stabilized projectile 130. The sub-projectile 130 has a front 134 and aft section 132. The front section 134 is the nose of the sub-projectile and is commonly made of steel. The aft section 132 of the sub-projectile 130 has a plurality of fins 136 which stabilize the sub-projectile 130 in flight. The forward guide disk 150 and the obturator 143 guide the saddle sabot 110 and the sub-projectile 130 down the bore or barrel without substantially engaging the rifling of the gun. This is possible since the obturator 143 and the forward guide disk 150 are able to make contact with a considerable portion of the diameter of the barrel of the gun. This prevents in-bore break up of the projectile and increases the accuracy of the sub-projectile.

By supporting the front 134 and the aft section 132 of the sub-projectile 130, the sub-projectile 130 is prevented from oscillating as it travels down the rifled barrel of the gun. This again prevents in-bore break up but further prevents the fins 136 from being damaged in the barrel. The saddle sabot 110 is an excellent guide for the sub-projectile 130, however is does have its drawbacks.

The saddle sabot 110 occupies a large extent of the volume which would otherwise be available for propellent 160. The area 165 located between the forward stabilizing disk 150 and the rear stabilizing disk 140 is essentially wasted since propellant 160 can not be ignited nor vented from this area 165. Therefore, manufacturers are forced to use a consolidated propellant 160 to attain performance goals.

Figure 2:
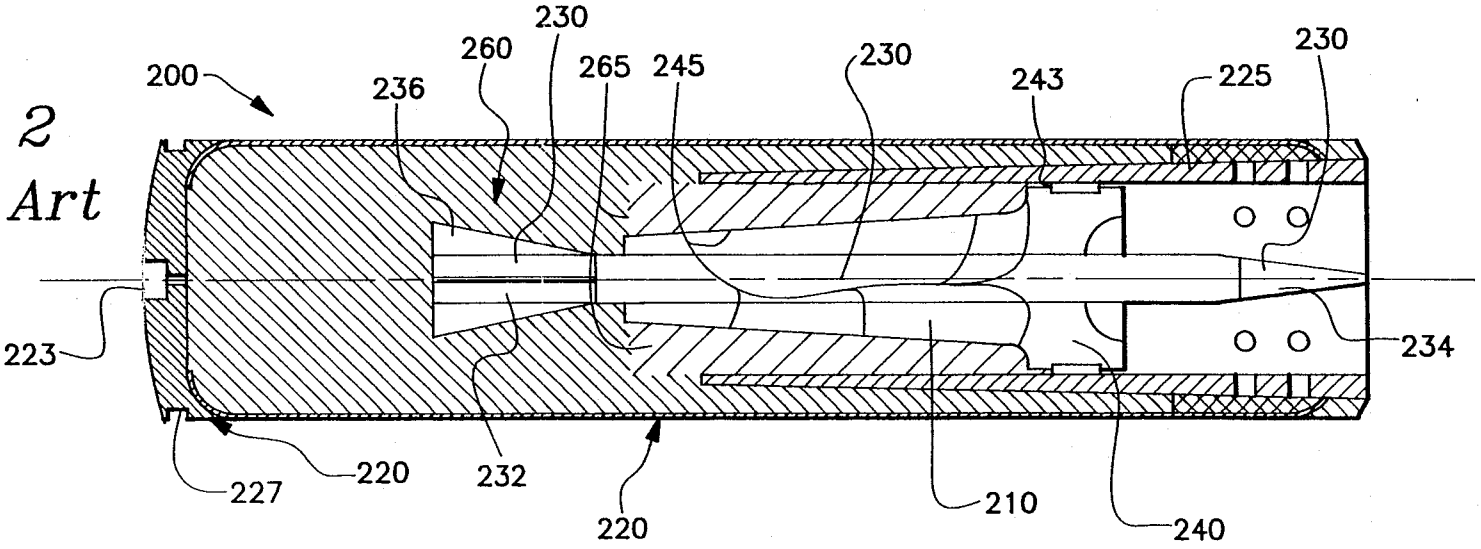
Fig. 2 Prior Art
FIG. 2 illustrates a puller sabot.

FIG. 2, reference 200 in general designates a puller sabot ammunition. The puller sabot 210 engages the peripheral mid section of a sub-projectile 230 as the saddle sabot of the previous example does. The puller sabot 210 is designed to increase the area available for propellant 260. This is accomplished by eliminating the rear stabilizing disk. Thus freeing the area 265 to be filled with propellant. The puller sabot has one stabilizing disk 240 located forward of the center of gravity of the sub-projectile 230. The sabot 210 is shaped such that the obturator 243 is located on the guide disk 240 and the surfaces behind the obturator 243 are pressure receiving surfaces 245.

The sabot 210 is inserted into a cartridge 220, the cartridge being a hollow cylinder with a sealed aft end 227. The aft end 227 of the cartridge is fitted with a primer 223 that ignites propellant 260. The forward end of the cartridge has a forward guide tube 225 of substantially the same diameter as the barrel of the gun. The forward guide tube 225 increases the volume of propellent 260 that the cartridge 220 can accommodate. The combination of a puller sabot 210 and the forward guide tube 225 increases the volume available for propellant considerably, thus permitting the manufacturer to use granular propellant to achieve the desired performance goals. If increased performance goals are desired, these may be achieved by using a consolidated propellant.

The puller sabot 210 has one inherent problem, that of stability. The puller sabot 210 does not guide the projectile as efficiently as the saddle sabot of FIG. 1. The rear of the sub-projectile 230 is able to oscillate thus permitting the fins 236 to be damaged, or at a minimum decreasing the accuracy of the sub-projectile 230.

Figure 3:
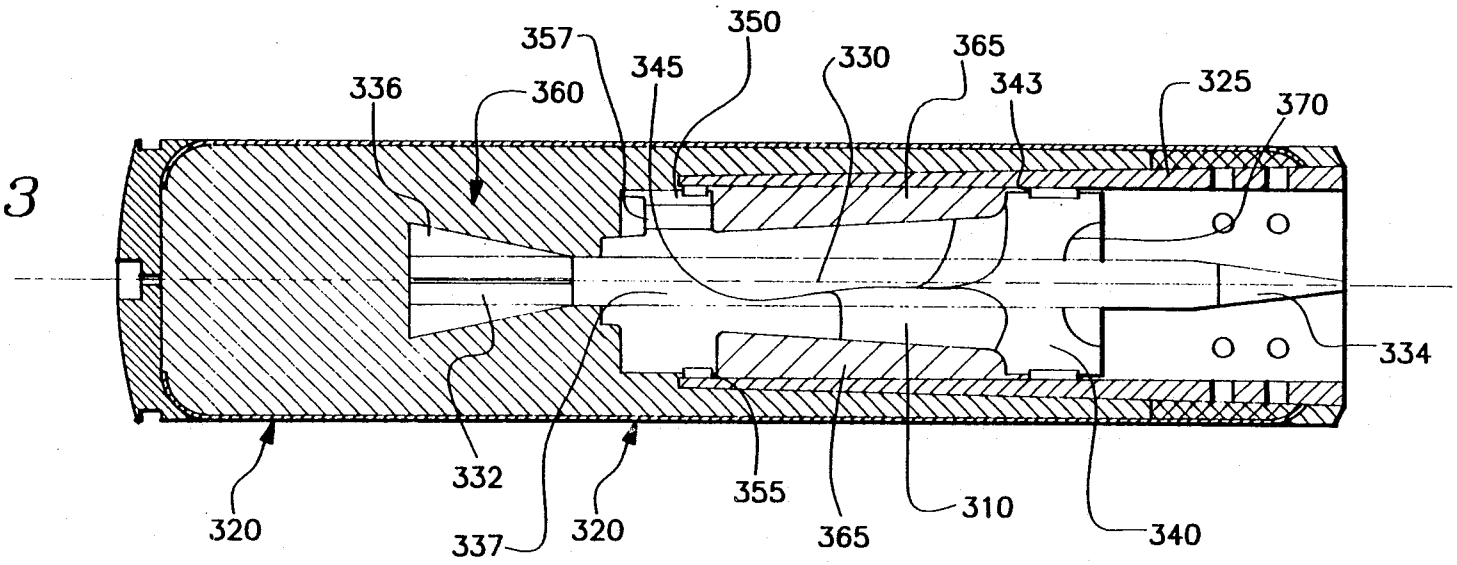
FIG. 3 illustrates the preferred embodiment of the invention.

FIG. 3 is an example of the invention in a cartridge 320 with a forward guide tube 325. The embodiment shown is for a 30mm ammunition. The invention incorporates all of the advantages of the two prior devices in an effective manner that guides the sub-projectile 330 and increases the area for propellant 360. The sabot 310 is a puller sabot similar to that shown in FIG. 2 with a forward stabilizing disk 340. The sabot 310 further comprises a rear stabilizing disk 350. The rear stabilizing disk 350 is fitted with a bore rider 355. The obturator 343 is located on the the forward stabilizing disk 340. The sabot 310 engages the peripheral mid section of the sub-projectile 330 as in the prior figures. The sabot 310 for this embodiment is made of an aluminum alloy.

The sub-projectile 330 is put together in pieces, the nose 334 and the fins 332 being fabricated from steel while the body of the sub-projectile is made of tungsten. The propellant 360 used in this embodiment is a single base single perforation combination of granular and consolidated propellant. These materials are standard for any cased telescoped ammunition using a long rod fin stabilized projectile.

The rear stabilizing disk 350 has a plurality of openings 357 extending longitudinally through the rear stabilizing disk 350. For a 30mm ammunition the rear stabilizing disk 350 has twelve openings 357 each with a diameter of 0.195 inches. The area of the openings is approximately 45% of the total disk area. This permits the obturator 343 and the pressure receiving surface 345 to receive the expulsion pressure forward of the rear stabilizing disk 350. It further allows for propellant 360 to be disposed around the mid section of the sabot 310 in area 365. The openings 357 must be of a substantial enough size such that the propellant located in area 365 may not only be ignited, but may also vent through the openings 357 in such a manner that a substantially unequal pressure does not exist in area 365 relative to area 360. The rear stabilizing disk further comprises a bore rider 355. The bore rider 355 and the obturator 343 are made of plastic or nylon for this embodiment. The bore rider 355 and the obturator 343 ride the bore of the rifle and not the rifling so as to avoid a substantial amount of spin being introduced to the projectile 330.

This invention incorporates the stability of the saddle sabot and the performance of the puller sabot through use of the vented rear stabilizing disk 350. The vents 357 in the rear stabilizing disk 350 move the pressure receiving surface 345 forward, increasing the volume available for propellant, while the rear stabilizing disk 350 guides the rear of the sub-projectile 330 thus eliminating oscillations. Further, by incorporating a disk system with a continuous peripheral surface, the rifling of the barrel is not imposed substantially upon the sub-projectile 330 as the sabot rides the bore of the rifle.

We claim:

1. An ammunition comprising:

(a) A long rod fin stabilized sub-projectile with a forward, rear, and mid section; and (b) a puller sabot characterized by a forward stabilizing disk, a rear stabilizing disk and mid section, said disks having a continuous peripheral surface, said forward stabilizing disk having an obturator, said rear stabilizing disk having a means for venting propellant gases, said means being a plurality of relatively substantial openings extending longitudinally through said rear stabilizing disk, said mid section of said sabot being of a smaller diameter than said stabilizing disks, and said sabot surrounding and engaging said mid section of said sub-projectile.

2. The ammunition of claim 1 further characterized by said rear stabilizing disk having at lest six of said openings, and said openings being cylindrical in shape, said openings encompassing at least 50% of said rear disk.

3. The ammunition of claim 2 further comprising a cartridge, said cartridge being a hollow cylinder with a sealed aft end and a forward end, said sub-projectile and said sabot being placed in said cartridge such that said sabot is substantially concentric with said cylinder, said aft end of said cartridge accommodating a primer, said forward end comprising a forward guide tube, said cylinder further comprising a propellant, said propellant being distributed inside said cartridge.

4. The ammunition of claim 3 further comprising a propellant being disposed around said mid section of said sabot.

5. The ammunition of claim 3 further characterized by said propellant being disposed around said mid section of said sabot.

* * * * *